United States Patent [19]

Mizusawa et al.

[11] 4,056,934

[45] Nov. 8, 1977

[54] AFTER-BURNING PREVENTIVE AND FLAME-OUT APPARATUS

[75] Inventors: Shinichiro Mizusawa, Okazaki; Chiharu Tamura, Toyota; Norihiko Nakamura, Mishima; Hiromichi Yanagihara, Susono, all of Japan

[73] Assignee: Toyota Jidosha Kogyo Kabushiki Kaisha, Toyota, Japan

[21] Appl. No.: 649,527

[22] Filed: Jan. 15, 1976

[30] Foreign Application Priority Data

Sept. 27, 1975 Japan ..... 50-116647
Oct. 15, 1975 Japan ..... 50-124079

[51] Int. Cl.[2] ..... F01N 3/06

[52] U.S. Cl. ..... 60/311; 55/276; 55/518; 55/DIG. 20; 55/DIG. 30; 181/264; 181/268; 181/265

[58] Field of Search ..... 60/311, 299, 303; 55/518, 276, 517, 523, DIG. 30, DIG. 20; 181/53, 54, 69, 36 C

[56] References Cited

U.S. PATENT DOCUMENTS

| | | | |
|---|---|---|---|
| 2,288,943 | 7/1942 | Eastman | 60/299 |
| 2,626,678 | 1/1953 | Yant | 55/518 |
| 2,772,537 | 12/1956 | Lisciani | 60/311 |
| 3,018,841 | 1/1962 | Gerlich | 55/518 |
| 3,048,960 | 8/1962 | Ohlson | 55/518 |
| 3,276,202 | 10/1966 | Gary | 60/299 |
| 3,719,457 | 3/1973 | Nagamatsu | 60/299 |
| 3,771,315 | 11/1973 | Scott | 60/311 |
| 3,815,337 | 6/1974 | Lenane | 60/311 |
| 3,952,507 | 4/1976 | Bonarski | 60/303 |

FOREIGN PATENT DOCUMENTS

| | | | |
|---|---|---|---|
| 2,219,192 | 10/1973 | Germany | 55/276 |
| 47-8811 | 10/1972 | Japan. | |

*Primary Examiner*—Douglas Hart

[57] ABSTRACT

For use in a muffler of an internal combustion engine improved flame-out apparatus includes first and second L-shaped screens each having a longitudinal section and a transverse section. The transverse sections are axially spaced apart and the space therebetween is occupied by a pair of axially spaced apart, transversely oriented perforated partition plates and flame extinguishing means.

8 Claims, 13 Drawing Figures

AFTER-BURNING PREVENTIVE AND FLAME-OUT APPARATUS

BACKGROUND OF THE INVENTION

The present invention relates to an after-burning preventive and flame-out apparatus for an internal combustion engine.

In the operation of a vehicle having an internal combustion engine mounted thereon, the engine is in such a state that it is prone to an accidental fire immediately after either running on a long sloping road, sudden speed reduction, racing, or gear change, and the said state might possibly result in after-burning in some cases. Besides, in general practice, a certain quantity of a live gas is suctioned into the engine due to the continuation of the motion of the engine by inertia, and is exhausted thereafter in the form of a non-ignited gas, through an exhaust system, even after the engine is switched off. Therefor, in case a heat source (hot spot) as is sufficient to ignite the live gas is present, such a live gas as ought to be exhausted as a non-ignited gas through the exhaust system is subjected to combustion in the exhaust system, to thus result in explosive after-burning. The flame that results from said explosive after-burning reaches as far as the live gas that fills the entirety of the exhaust system, especially as far as the live gas that stagnates in the main muffler, thus being subjected to explosive combustion, until the pressure is raised, whereby the gas is caused to be exhausted through the outlet of the exhaust system at the speed well equivalent to the acoustic velocity, and this has thus far constituted such a series of defects as affect in a harmful manner the respective sections of a vehicle having an internal combustion engine mounted thereon as well as the environment outside the vehicle, as well as the exhaust system itself. To put it otherwise, such explosive after-burning often generates a quite high level of knocking, so also does it give off sparks out of a tail pipe at the outlet of the exhaust system in some case, which has thus far constituted a hazard.

Introduced to date as the methods of preventing the after-burning of this category have been: (1) means for causing a non-ignited gas mixture as is discharged from an engine to be subjected to combustion in an upstream section of a sound deadening apparatus, (2) means that subjects either an exhaust manifold or a thermal reactor to cooling in a proper manner to thus keep a non-ignited gas mixture free from being subjected to spontaneous ignition, and (3) means providing that, in case explosion should take place in the course of running of a non-ignited gas mixture through the exhaust system of a sound deadening apparatus, the flame and/or the explosive sound resulting thereby are so controlled as to be properly extinguished and/or deadened by means of a flaming-out apparatus and/or a sound deadening apparatus at the outlet of an exhaust pipe. The present invention relates to the third one of the methods set forth above. One of the conventional methods similar to that being introduced herein and presently available is such wherein, either a wire mesh, a filter, or the like is arranged in place at the outlet of an exhaust pipe. However the prior art method is not specifically designed for the purpose of effectuating flame-out but is designed for the purpose of preventing red-hot sparks of carbon from being scattered around, and the mesh of a wire mesh is required to be so formed as to be fine enough. This prior art method still involves such a series of inherent defects that the mesh is prone to be subjected to clogging, and, in case non-ignited gas mixture should be subjected to explosion in a sound deadening apparatus, a quite intensive flame is jetted out, which has hitherto made it difficult to prevent after-burning in a proper manner.

SUMMARY OF THE INVENTION

Now, one purpose of the present invention resides in providing an after-burning preventive apparatus of such a new construction as is well capable of overcoming the said difficulties involved in the conventional after-burning preventive method. More specifically, the present invention provides an after-burning preventive apparatus of a new construction which includes a flaming-out apparatus that is arranged in place for effectuating proper flame-out in the middle of an exhaust system of an internal combustion engine for the purpose of preventing an explosion of a non-ignited gas mixture from taking place at the time of speed reduction or shut down of the internal combustion engine, whereby such a non-ignited gas mixture as runs in the wake of passing through the said flaming-out apparatus is properly kept free from being subjected to combustion, and the pressure of the non-ignited gas mixture is properly checked from rising up to such a level as corresponds to the acoustical velocity.

Another purpose of the present invention resides in providing a sound deadening apparatus coupled with an after-burning preventive apparatus of such a new construction as is well capable of overcoming the said difficulties involved in the conventional after-burning preventive method. More specifically the present invention provides a sound deadening apparatus of such a new construction that features a narrow and curved flow path for an exhaust gas with the flow path being properly formed in the interior of the sound deadening apparatus whereby a flame is properly prevented from being spread all around.

In case the flame-out apparatus according to the present invention is not employed, (1) a gas mixture that is suctioned by inertia force of an engine, when the engine is switched off, is discharged into an exhaust system in the state of a live gas, (2) and the gas mixture which is exposed to comparatively high temperature in the exhaust system, is then subjected to ignition by the heated surface (550° C~600° C or over) in the interior of an exhaust manifold or a thermal reactor which is hard to cool. A flame thus taking shape reaches as far as a live gas present inside a main muffler, ignites the live gas in the main muffler, and subjects the said live gas to combustion in an explosive manner, until the combustion gas having the pressure thereof raised by the combustion is thus caused to be jetted out of the outlet of the exhaust system at the acoustical velocity. By way of contrast, where the flame-out apparatus according to the present invention is employed, the live gas present and stagnating in the exhaust manifold or the thermal reactor through the flame-out apparatus to be subjected to combustion, the pressure of the gas is kept free from rising up to so high a level as to be jetted at the velocity of sound, and only stays on such a level as simply generates a slight sound of after-burning, whereby an effect of preventing an explosion can be attained, especially such a category of after-burning as results at the time of cut-off of ignition can be prevented in a proper manner. Besides, the flame-out apparatus of this invention can achieve a subsidiary effect of proper sound deadening.

BRIEF DESCRIPTION OF THE DRAWINGS

Now, a detailed description of the present invention will be given below, with regard to some illustrations thereof, by making reference to the drawings attached hereto.

DETAILED DESCRIPTION OF THE INVENTION

Figure 1:
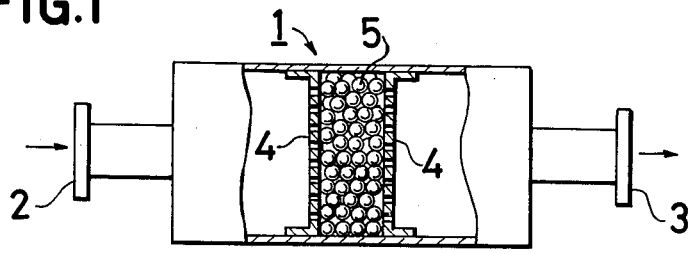
FIG. 1 through FIG. 5 are sectional drawings of illustrations wherein respectively different fillers are employed.
Figure 2:
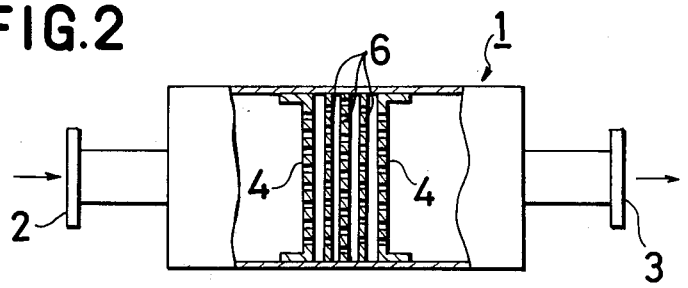
Figure 3:
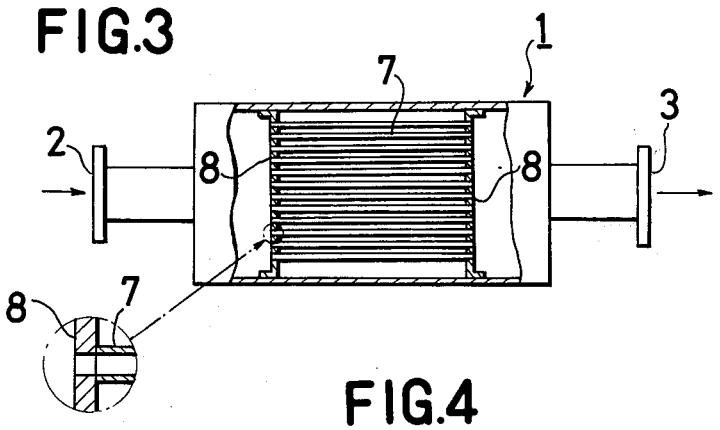
Figure 4:
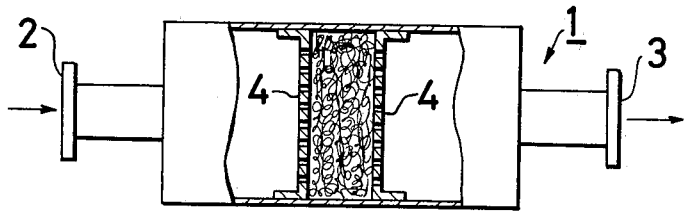
Figure 5:
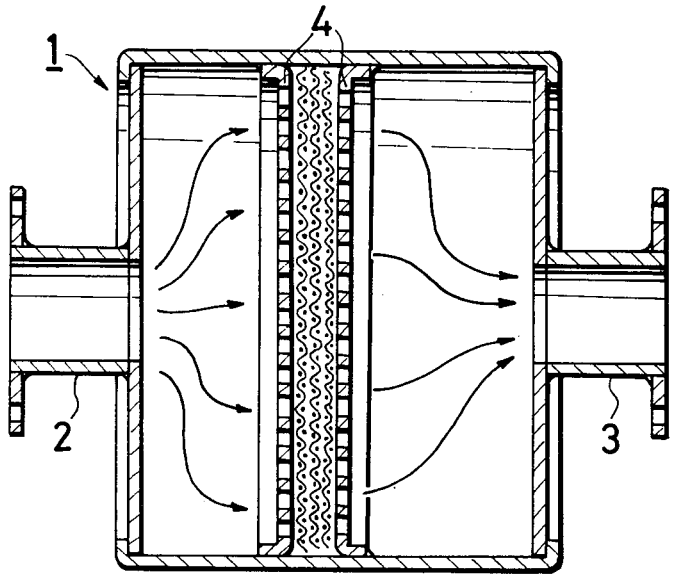
Figure 6:
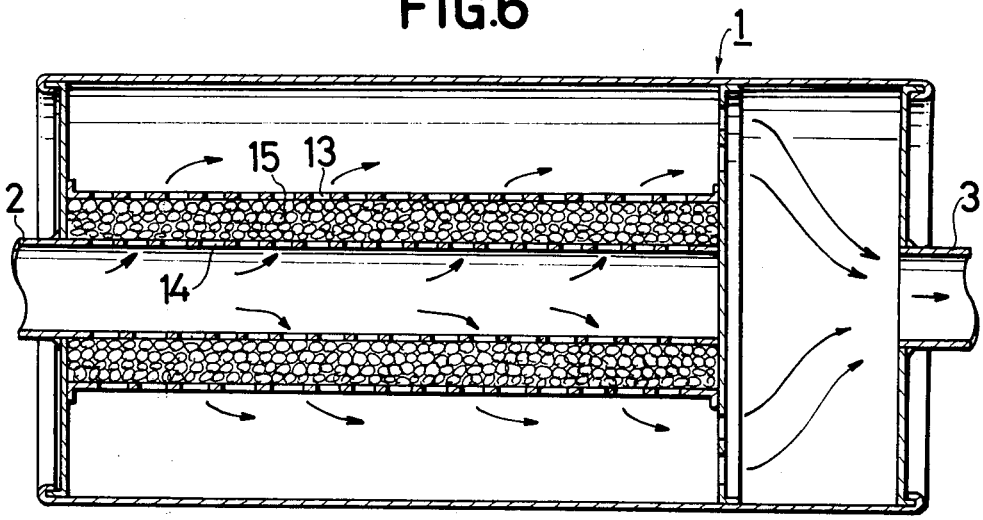
FIG. 6 shows a sectional view of another form of the present invention.

The flame-out apparatus 1 shown in FIG. 1 is shaped like a hollow container and is provided with an inlet 2 and an outlet 3. A space in the said flame-out apparatus is formed by a pair of axially spaced apart porous plates 4, 4 with the space being filled with pieces of globules 5 of approximately 2mm through approximately 7mm in diameter. The globules 5 have no oxidative catalytic action on a non-ignited gas mixture and may be made of aluminum oxide globules, steel globules, glass globules, and/or the like. In this case, for the purpose of forming a path of a flame in such a manner as to constitute a maze, at least three layers of the globules are required to be arranged in the direction of the flow of the flame. The globules 5 are larger in heat capacity than a wire mesh or the like, so that the sectional area of the path of a comparatively large dimension provides a superb flame-out effect, and such an advantage that causes no clogging to take place. Furthermore, for the purpose of ensuring the flame-out action by the said globules to be carried out in a secure manner, the temperature of the globules before the flame reaches the globules is required to be 600° C or less. Therefore, the flame-out apparatus is arranged in place in the direction of the down flow sufficiently away from an exhaust manifold and a thermal reactor, and is subjected to sufficient cooling by the air blowing from the direction of movement of a vehicle. Shown in FIG. 2 is an embodiment wherein a plurality of porous plates 6, 6 . . . are combined and arranged in place in the same space formed in the same manner as in the case of that which is shown in FIG. 1, the diameter of each aperture in the plate 6 being approximately 1mm through approximately 3mm, the thickness of the porous plates 6 being approximately 5mm through approximately 25mm. The apertures in the plate 6 are offset from one another to form a maze, and the flame is subjected to proper flame-out, while running through the said maze. In the embodiment shown in FIG. 3, a flame is subjected to flame-out, while the flame runs through a plurality of hollow pipes 7, 7, . . . arranged in place in the same space formed in the same manner as in the embodiments shown in FIG. 1 and FIG. 2. The said pipes 7 are approximately 1mm through 3mm in inner diameter, and approximately 100mm through 150mm in length. In the embodiment shown in FIG. 4, a plurality of wires, metallic pieces, and/or the like fill the space formed in the same manner. In the embodiment shown in FIG. 5, the space thus formed is filled with from three layers to ten layers of wire meshes of #10 through #100 in mesh. When the flame of a gas mixture that as is subjected to spontaneous ignition near the exhaust manifold or the thermal reactor reaches the flame-out apparatus, the said flame is prone to be further transmitted in the direction of the down flow thereof. However, the said flame undergoes a quenching action by the said stainless wire mesh layer, thus preventing an explosion from taking shape. In this case, when the mesh of the wire mesh is #10 or less, a flame is left to pass through the wire mesh. Therefore, it is imperative that the mesh of the wire mesh should be finer than that. However, a wire mesh of a finer mesh than #100 causes the exhaust pressure to rise up and therefore is not recommended for practical purposes. Besides, in the case of a wire mesh made of a fine and thin wire, the heat capacity thereof is small, and a single layer of such a wire mesh is not effective enough for preventing a flame from passing through the said wire mesh. Therefore, in case a wire mesh of this category is selected, the wire mesh is required to be in as at least three layers. Furthermore, for ensuring the flame-out action to be conducted in a secure manner, it is imperative that the temperature of the wire mesh before the flame reaches the wire mesh should be 600° C or lower. To cope with the requirement, it is imperative that the flame-out apparatus 1 should be arranged in the direction of the down flow of the exhaust manifold or the thermal reactor, and be kept in the state of being sufficiently cooled by the air blowing from the running direction, in the same manner as is shown in FIG. 1. Shown in FIG. 6 is still another embodiment of the invention wherein the exhaust resistance is properly caused to be reduced. In this embodiment porous plates 13, 14 have a tubular shape, and have globules 15 as are shown in the embodiment of FIG. 1 which globules are properly selected to fill the space between the said porous plates 13 and 14. In the drawing, an arrow designates the direction of the flow of an exhaust.

Figure 7:
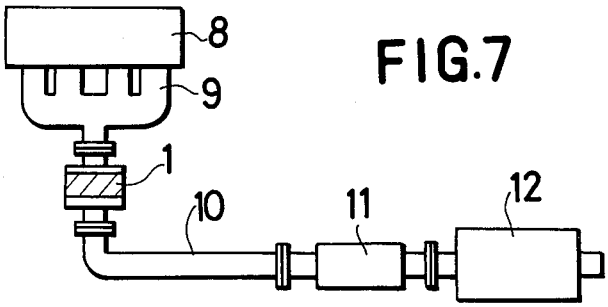
FIG. 7 through FIG. 9 show some illustrations of the present invention wherein the position thereof in the flame-out apparatus are different from one another.
Figure 8:
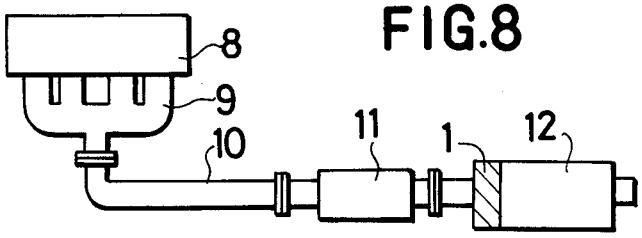
Figure 9:
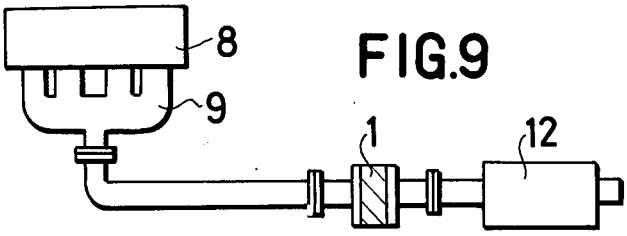

FIG. 7 through FIG. 9 are schematic drawings specifically illustrating several different positions of the flame-out apparatus as is set forth in the preceding paragraphs. Shown in FIG. 7 is the arrangement of the flame-out apparatus immediately in the rear of the exhaust manifold or the thermal reactor 9 in the wake of an engine 8, and a connecting pipe 10 following the said flame-out apparatus 1 with a sub-muffler 11 and a main muffler 12 properly connected therewith. Compared with such a case wherein the flame-out apparatus is arranged further downstream, the arrangement shown in FIG. 1 has a higher level of atmospheric temperature. Therefore, durability is subjected to deterioration, and the cooling capacity of the flame-out apparatus is rather inferior. However, since the quantity of the gas to be consumed for burning is rather small, the flame-out capacity of a low level may suffice. In the arrangement shown in FIG. 8, the flame-out apparatus 1 is arranged in place near the inlet of the main muffler 12 following the sub-muffler 11 through the connecting pipe 10 from the exhaust manifold or the thermal reactor 8. In the arrangement of FIG. 8, the atmospheric temperature is low, unlike the arrangement shown in FIG. 7 and the flame-out apparatus is superb in terms of the durability and the cooling capacity thereof. However, the quantity of the gas to be consumed for burning is higher. Therefore, such a filler for the flame-out apparatus as has the gas pressure taken into due account is required. Shown in FIG. 9 is an arrangement of the flame-out apparatus at an intermediate position between the position shown in FIG. 7 and the position of the example shown in FIG. 8, whereby the durability, the cooling capacity, and the flame-out capacity of the flame-out apparatus are all designed so as to be moderate and reasonable.

Figure 10:
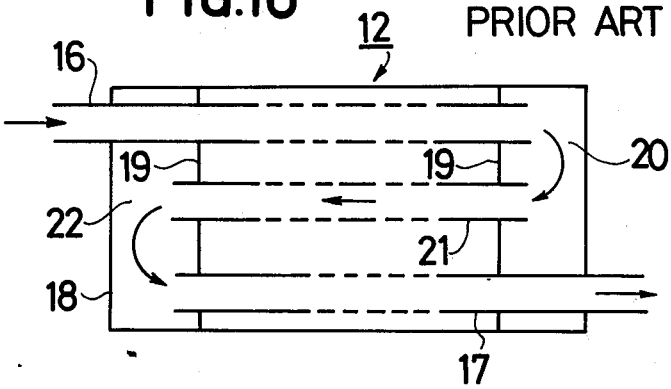
FIG.10 PRIOR ART
FIG. 10 is a sectional view of one example of conventional sound deadening apparatus.
Figure 11:
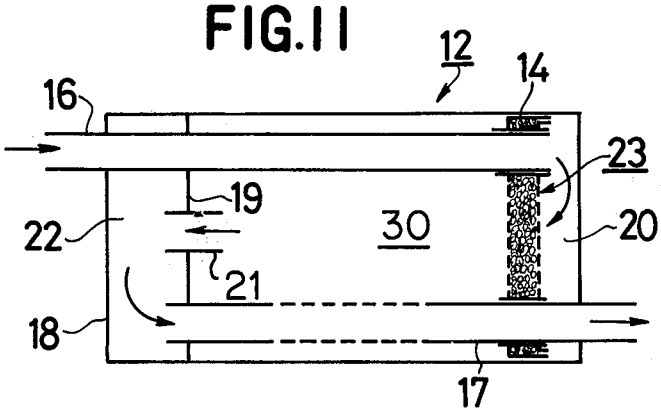
FIG. 11 is a sectional view of one form of the present invention.
Figure 12:
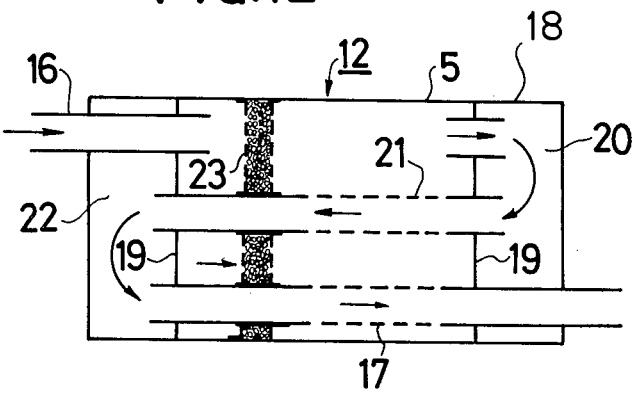
FIG. 12 is a sectional view of another embodiment of the present invention.
Figure 13:
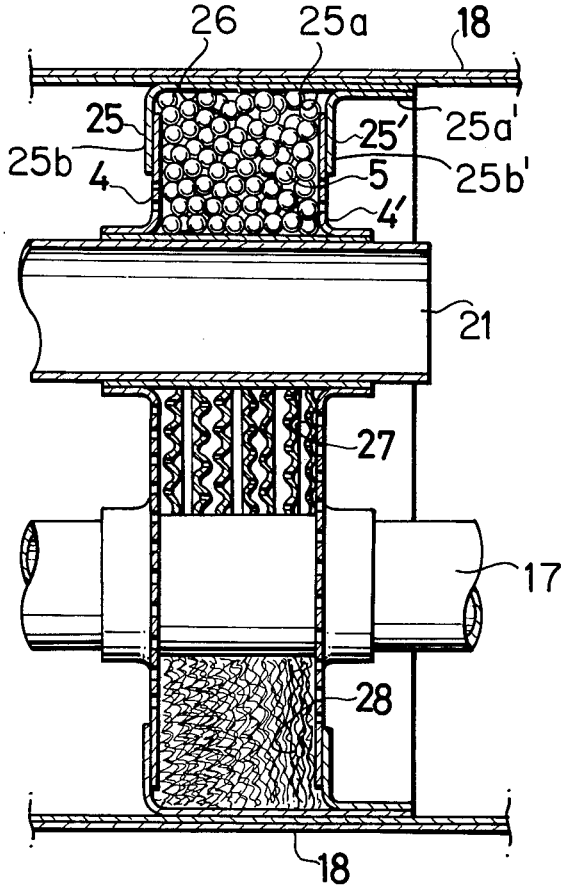
FIG. 13 is a detailed sectional view illustrating the mounting of the apparatus according to the present invention on the sound deadening apparatus and a pipe therefor, respectively.

Next, as still other illustrations of the present invention, for example wherein the flame-out apparatus is arranged in place in the sound deadening apparatus, as in the case of that which is shown in FIG. 8, are as shown in FIG. 11 through FIG. 13. Prior to giving a description thereof, a sectional view of an example of the conventional sound deadening apparatus for a vehicle with an internal combustion engine mounted thereon will be shown in FIG. 10. An exhaust gas runs into the sound deadening apparatus 12 through an inlet pipe 16, and is exhausted out of an outlet pipe 17 through such a route as is generally termed a route of the three-path system. To put it in more specific terms, the inlet pipe 16 causes a portion of an exhaust to leak out through a plurality of apertures formed by drilling through the said inlet pipe 16 in such a chamber as is formed by separators 19, 19 set in place in the interior of the outer body 18 of the sound deadening apparatus 12, while most of the outer portion of the exhaust runs into an inner pipe 21 through a rear chamber 20 in the sound deadening apparatus, as well as through an opening of the inlet pipe 16 passing through the said separators 19, 19, returns into the front chamber 22 of the sound deadening apparatus, and runs through the outlet pipe 17, then is discharged to the outside of the sound deadening apparatus.

The present invention is shown in a sectional view in FIG. 11. The same portions as those shown in FIG. 10 will be given the same numerical symbols. Such an exhaust as is led into the sound deadening apparatus 12 through the inlet pipe 16 and is led intact into the rear chamber 20 in the sound deadening apparatus, wherefrom the exhaust runs back through the sound deadening apparatus, and runs through the flame-out apparatus 23. Details of the said flame-out apparatus 23 are as shown in FIG. 13. A filling chamber 26 for the filler is formed of porous plates 4, 4 properly welded, respectively, with a spacing of 15mm or more, on such an L-shaped screen member 25 that is welded on the inner surface of an outer body 18, and on another L-shaped screen member 25' that is further welded on the said screen member 25. A plurality of globules 5 made of, for example, alumina, specifically provided to fill the space in the said filling chamber in a close manner. A flow of the exhaust runs through the said flame-out apparatus 23, so also does such a flame that results from the ignition of a live gas, on the occasion the said flame is transmitted, and the said flame is subjected to flame-out in a proper manner in the course of running through the flame-out apparatus. After running through the flame-out apparatus 23, the flow of the exhaust runs back through a central chamber 30 in the sound deadening apparatus and reaches the front chamber 22, then is discharged out of the sound deadening apparatus from in the outlet pipe 17 provided with a porous section on a part thereof. Such portions of the inlet pipe 16, the outlet pipe 17 and the inner pipe 21 as are shown by a broken line in the drawing, respectively, represent the portions having a plurality of apertures properly formed by drilling. In the case of the embodiment shown in FIG. 12, the flame-out apparatus 23 is set in place at a comparatively forward section in the sound deadening apparatus, unlike the one shown in FIG. 11, and in this case the exhaust is led to the front of the flame-out apparatus by the inlet pipe 16 through the separator 19. In case a flame is found to have been subjected to transmission at this stage, the flame is subjected to flame-out, the exhaust following the flame-out is caused to return into the front chamber 22 from the rear chamber 20 through the inner pipe 21, then runs into the outlet pipe 17, and is discharged out of the sound deadening apparatus, after passing through the separators 19, 19. Shown in FIG. 13 is a detail of the flame-out apparatus. A filling chamber 26 for a filler is formed of porous partition plates 4, 4' respectively welded on an L-shaped screen member 25 which is welded on the inner surface of the outer body 18 and on another L-shaped screen member 25' which is further welded on one side of the said screen member 25. The L-shaped screen member 25 is defined by a longitudinally extending body portion **25*a* welded to the inside surface of the outer body 18 and a transverse flange portion 25*b* extending inwardly from one end of the body portion 25*a*. Similarly, the other L-shaped screen member 25' is defined by a longitudinally extending body portion 25*a'* welded to the inside surface of the body portion 25*a* and a transverse flange portion 25*b'* extending radially inwardly from one end of the body portion 25*a'*. The space 26 between the plates 4, 4' s filled with a plurality of the said alumina globules 5 of 3mm or less in diameter, laminated punched metal sheets 27 provided with a plurality of hemispherical projections, metal laths 28, laminated louver plates, laminated wire meshes of #10 through #100 in mesh, steel wool, and/or a combination thereof, specifically selected as the filler therefor. Furthermore, for the purpose of preventing a flame from blazing up between the said flame-out apparatus 23 and the outer body 18 of the sound deadening apparatus, and for the purpose of preventing a flame from blazing up through that portion where the inlet pipe 16, the outlet pipe 17, and/or the inner pipe 21 run(s) through the flame-out apparatus, as well as for the purpose of preventing a container from being subjected to a thermal change, the peripheral section of the flame-out apparatus and the outer body 18 of the sound deadening apparatus 12 are connected with each other by means of screen members 25, 25'** each having an L-shaped section. With regard to such sections where a pipe is laid through, a plate is set in place at the both outer ends of the punched plate, or a plate is set in place at the both outer ends of each laminated matter. In the case of the filler comprising a plurality of laminated matters, is bent to have the shape of an L, or the said L-shaped bent section is welded intact on the pipe, or on a strip steel plate welded on the pipe, thus preventing a flame from blazing up.

What is claimed is:

1. In a muffler for an internal combustion engine, including an after-burning preventive and flame-out apparatus provided therein, so that flame which takes place in the course of running of a gas mixture through an exhaust system from the engine to the muffler may be extinguished by means of an improved flame-out apparatus comprising:

a first L-shaped screen member including a longitudinally extending body portion and a transversely oriented flange portion extending inwardly from one end of said body portion, the outer face of said body portion being welded to the inner face of the outer body of the muffler;

a second L-shaped screen member including a longitudinally extending body portion and a transversely oriented flange portion extending inwardly from one end of said body portion of said second L-shaped screen member, the outer face of said body portion of said second L-shaped member being welded to the inner face of said body portion of said first L-shaped screen member with said body portion of said first L-shaped screen member being longer than said body portion of said second L-shaped screen member in the axial direction so that said flanged portion of said first L-shaped screen member is axially spaced from said flanged portion of said second L-shaped screen member;

a pair of transversely oriented partition plates each having a plurality of small openings, the axially outer surface of one of said partition plates being welded to the axially inner surface of said flange portion of said first L-shaped screen member while the axially outer surface of said other partition plate being welded to the axially outer surface of said flange portion of said second L-shaped screen member whereby an axially extending space is defined between said pair of partition plates; and flame extinguishing means filling said axially extending space between said pair of partition plates and the inner surface of said body portion of said first L-shaped screen member for extinguishing the flame which takes place in the gas exhaust system.

2. The muffler as defined in claim 1 wherein said flame-out apparatus is provided between a first separator supporting one end of an inlet pipe, one end of an inner pipe and one end of an outlet pipe and a second separator supporting the other end of said inner pipe and a portion of said outlet pipe.

3. The muffler as defined in claim 2 wherein said pair of partition plates each have flange portions the outer surfaces of which are welded to the respective surfaces of said inner pipe and said outlet pipe.

4. The muffler as in claim 3 wherein said flame extinguishing means comprises globules of approximately 2 mm. to approximately 7 mm. in diameter that have no oxidative catalytic action on a non-ignited exhaust gas mixture, at least three layers of said globules being arranged in the direction of the flow of the flame so as to form a path for the flame in such a manner as to constitute a maze.

5. The muffler as in defined in claim 1 wherein a front chamber, a central chamber and a rear chamber are defined by the inner wall of the muffler, said flame-out apparatus and a separator having an opening respectively; an inlet pipe being supported by both said flame-out apparatus and said separator so as to communicate with said front chamber; an outlet pipe supported by both said flame-out apparatus and said separator so as to communicate with said central chamber; the size of said front chamber being selected such that no explosion may take place therein.

6. The muffler as defined in claim 5 wherein said outlet pipe has a plurality of small openings communicating with said central chamber.

7. The muffler as defined in claim 5 wherein said pair of partition plates each have flange portions, the outer surfaces of which are welded to the respective surfaces of said inlet pipe and said outlet pipe.

8. The muffler as defined in claim 7 wherein said flame extinguishing means is comprised of globules of approximately 2 mm. through approximately 7 mm. in diameter that have no oxidative catalytic action on a non-ignited exhaust gas mixture, at least three layers of said globules being arranged in the direction of the flow of the flame so as to form a path for the flame in such a manner as to constitute a maze.

* * * * *